United States Patent [19]

McClure et al.

[11] 4,449,033

[45] May 15, 1984

[54] THERMAL PRINT HEAD TEMPERATURE SENSING AND CONTROL

[75] Inventors: Richard G. McClure, Georgetown; James M. Rakes, Leander; Errol R. Williams, Round Rock, all of Tex.

[73] Assignee: International Business Machines Corporation, Armonk, N.Y.

[21] Appl. No.: 452,989

[22] Filed: Dec. 27, 1982

[51] Int. Cl.[3] ..... H05B 1/02

[52] U.S. Cl. ..... 219/216; 346/76 PH

[58] Field of Search ..... 219/216 PH; 400/120; 346/76 PH, 76 R

[56] References Cited

U.S. PATENT DOCUMENTS

| | | | |
|---|---|---|---|
| 3,453,647 | 7/1969 | Bernstein et al. | 346/76 |
| 3,577,137 | 5/1971 | Brennan | 219/216 PH |
| 3,813,513 | 5/1974 | Vora et al. | 219/216 |
| 3,874,493 | 4/1975 | Boyd | 219/216 PH |
| 3,953,708 | 4/1976 | Thornburg | 219/216 |
| 4,039,065 | 8/1977 | Seki et al. | 197/1 R |
| 4,099,046 | 7/1978 | Boynton et al. | 219/216 |
| 4,136,274 | 1/1979 | Shibata et al. | 219/216 |
| 4,219,824 | 8/1980 | Asai | 346/76 PH |
| 4,232,212 | 11/1980 | Baraff et al. | 219/216 |
| 4,242,565 | 12/1980 | Schoon | 219/216 |
| 4,246,587 | 1/1981 | Reilly et al. | 346/1.1 |
| 4,250,375 | 2/1981 | Tsutsumi et al. | 219/216 |
| 4,271,414 | 6/1981 | Williams et al. | 346/76 PH |

FOREIGN PATENT DOCUMENTS

| | | | |
|---|---|---|---|
| 53-116847 | 10/1978 | Japan | 346/76 PH |
| 54-141650 | 11/1979 | Japan | 346/76 PH |
| 55-39333 | 3/1980 | Japan | 346/76 PH |
| 55-51574 | 4/1980 | Japan | 346/76 PH |

OTHER PUBLICATIONS

Kitamura, K., "Thermal Printer Head Free from Overheating", IBM Tech. Disclosure Bulletin, vol. 16, No. 8, Jan. 1974.

*Primary Examiner*—C. C. Shaw
*Assistant Examiner*—Teresa J. Walberg
*Attorney, Agent, or Firm*—Andrea P. Bryant

[57] ABSTRACT

In a thermal print head employing a line of print elements, temperature sensing is effected by means of an elongated temperature sensing device positioned in parallel with the line of elements and in heat-transfer proximity thereto. The sensor may be of thermo-resistive material and is coupled to a control circuit to effect energy control of drive pulses to the print elements.

11 Claims, 3 Drawing Figures

THERMAL PRINT HEAD TEMPERATURE SENSING AND CONTROL

DESCRIPTION

1. Technical Field

The present invention relates to the sensing and control of the temperature of a thermal print head.

2. Background Art

Many thermal printing devices have been shown in the prior art. Such devices include matrices of elements for character formation, rows of elements for line printing, movable heads which traverse a sheet for printing and fixed heads which extend across a sheet for printing thereon as the sheet moves therepast.

Examples of such devices are shown in U.S. Pat. Nos. 3,453,647 (Bernstein et al), 4,039,065 (Seki et al), 4,136,274 (Shibata et al), 4,242,565 (Schoon), 4,250,375 (Tsutsumi et al) 3,953,708 (Thornburg), and 3,813,513 (Vora et al). In addition, row printers using a continuous bar of resistive material are shown in U.S. Pat. Nos. 4,099,046 (Bryton et al), and 4,232,212 (Baraff et al). It is to this general type of printer that the present invention is particularly, but not exclusively, directed.

It has been recognised that temperature control of a thermal print head is desirable. In U.S. Pat. Nos. 4,246,587 (Reilly et al) and 4,271,414 (Reilly et al) such temperature control or limitation is achieved by ordering the printing such that data printed in a given line is selected as a function of the data printed in a previous line. In U.S. Pat. No. 4,219,824 (Asai) the output voltage of the drive source is increased as a function of the number of elements to be driven at any one time, thereby ensuring that the temperature of each operating element is maintained.

Lastly, it is known to sense the temperature of integrated and printed circuits by placing discrete sensors at appropriate positions thereon.

In general, in thermal print heads, the print elements must be capable of producing a temperature greater than that required to mark a sheet, but less than that required to burn or deform the sheet. Variations in parameters such as ambient temperature, printhead temperature rise after sustained printing, and print element resistance all cause difficulties in maintaining the desired print temperature. One particular difficulty is the problem in preventing temperature rise in a few only of the print elements when, for example, a vertical line is printed on a sheet, or a solid block area is printed thereon.

DISCLOSURE OF THE INVENTION

The present invention provides an arrangement for sensing the temperature of each of a full row of thermal print elements. The sensing is effective not only when the general ambient temperature about the row rises but also when the temperature of only a few of the elements rises above a required limit.

In accordance with one aspect of the invention, there is provided in a thermal print head having a row of thermal print elements, a temperature sensor comprising a sensor bar of temperature sensitive material positioned in parallel with and in heat transfer proximity to, the row of print elements.

In accordance with a further aspect of the invention, there is provided a thermal print head comprising a continuous bar of resistive material, electrical connections to the bar defining print elements therebetween and a sensor bar of temperature sensitive material positioned in parallel with, and in heat transfer proximity to, the bar of resistive material.

In accordance with yet another aspect of the invention, there is provided a temperature control system for a thermal print head having a row of thermal print elements, comprising a temperature sensor bar positioned in parallel with, and in heat transfer proximity to, said row of thermal print heads and a control circuit coupled to the sensor bar and operative to control the energy of print drive pulses applied to the print elements in accordance with the temperature sensed by the sensor element.

BEST MODE FOR CARRYING OUT THE INVENTION

Figure 1:
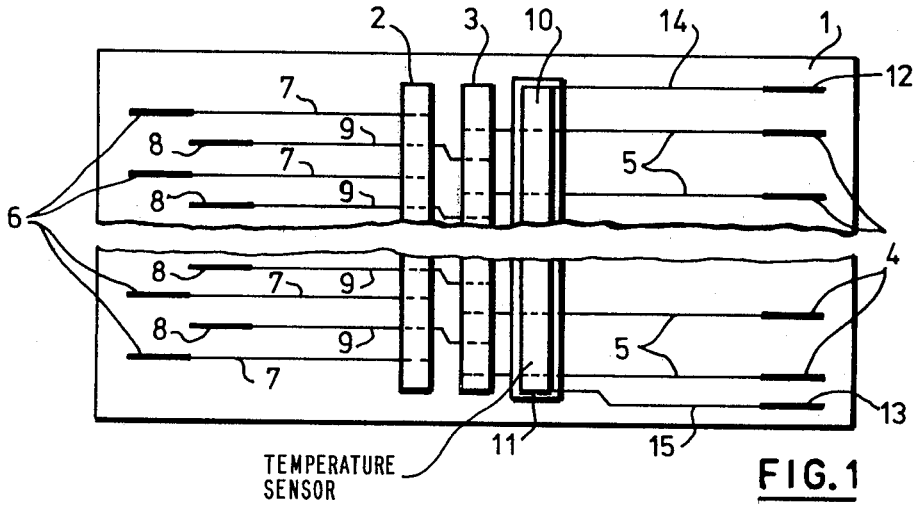
FIG. 1 is a partially broken top view of a thermal print head incorporating a temperature sensor.

FIG. 1 is a top view, partially broken away, of a thermal print head. This head comprises a substrate 1 supporting a pair of print bars 2, 3 of resistive material. A plurality of connector pads 4 are connected to lines 5 which extend under, and connect to, bar 3. Further connector pads 6 are similarly connected to bar 2 through lines 7. Yet another set of connector pads 8 are connected, through lines 9, first to bar 2 and then to bar 3. The lead connections to the print bars 2 and 3 define print elements therebetween. These elements are energised in a sequence of four stages. In the first stage, selected ones of leads 9 are driven and a ground return is completed for the lowest one of leads 5 and alternate ones of these leads. In the second stage, selected leads 9 are driven and the remaining leads 5 are ground returned. In the third stage selected leads 9 are driven and a ground return for the lowest lead 7 and alternate ones of these leads is made. Lastly in the fourth stage, selected ones of leads 9 are again driven and the remaining ones of lines 7 are grounded. In this four stage operation a single line of dots is formed on a sheet passing across the print bars 2, 3 from right to left in FIG. 1. The print bars 2, 3 are of a length to extend fully across the width of such a sheet. The sheet may be of thermally sensitive material, in which case it contacts the print bars. Alternatively a sheet carrying heat-transferable ink may be sandwiched between a plain paper sheet and the print bars to effect printing on the plain sheet.

Figure 2:
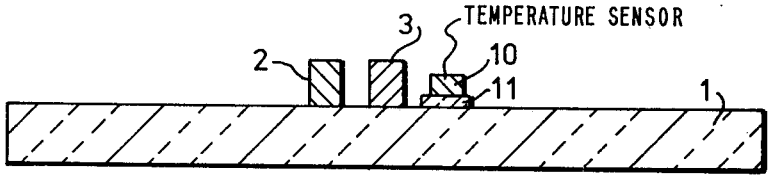
FIG. 2 is a side view of the print head of FIG. 1.

As has been indicated above, it is desirable to effect temperature control of a thermal print head. In order to achieve this, a sensor bar of thermo-resistive material 10 is positioned parallel, and in close proximity to print bar 3. Sensor bar 10 is insulated from leads 5 by a layer of insulant 11 for example, glass. FIG. 2 shows the arrangement of the print and sensor bars. This figure has been simplified by omitting the leads and connector pads. In FIG. 2, it will be seen that the bars 2 and 3 extend further from the substrate 1 than the insulant/-sensor bar combination to avoid the sensor bar contacting a sheet in contact with the print bars. It will be seen that the sensor bar is heated by conduction from bar 3. In practice, this conduction is concentrated on to the sensor bar by a sheet in contact with bar 3. Referring back to FIG. 1, connector pads 12 and 13 are connected to respective ends of sensor bar 10 by means of leads 14 and 15.

It should be noted that FIGS. 1 and 2 are highly magnified views of the print head. In a practical device, the substrate 1 is a slice of silicon material with the leads and pads screened thereon. The glass insulating layer 11 is formed over leads 5, and leads 14 and 15 are screened onto substrate 1 and over insulating layer 11. The print bars 2, 3 are then screened over the leads 5, 7, 9 for connection thereto. Temperature sensor bar 10 may be formed from a paste of thermo-resistive material with a negative temperature coefficient, which, after laying down, is hardened. Typical dimensions are, length of bars, 200 mm, and 0.19 mm spacing between longitudinal center lines of the bars.

Figure 3:
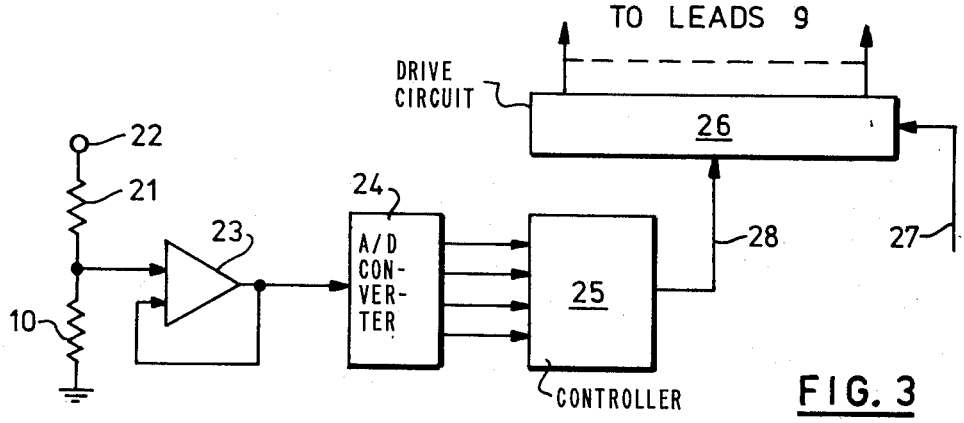
FIG. 3 is a simplified block diagram of a temperature control system for use with the print head of FIGS. 1 and 2.

FIG. 3 is a simplified block diagram of a temperature control circuit for the FIG. 1 print head. The sensor bar 10 is connected in series with a resistor 21 between a terminal 22 coupled to a voltage reference source and earth. The voltage developed across sensor bar 10, which varies in accordance with the temperture of the bar, is fed to operational amplifier 23, which acts as an isolating amplifier. The output from amplifier 23 is applied to an anlog-to-digital converter 24, to provide digital outputs representative of the sensor bar temperature. These outputs are applied to a controller 25 which may, for example, be a micro-processor. The resultant output from the micro-processor on line 28 controls a shift-register/drive circuit 26, which applies the drive pulses to leads 9 (FIG. 1) in parallel in response to line data received serially on line 27. The signal on line 28 may control either the width or amplitude of the drive pulse output from shift register/driver 26. Thus, when sensor bar 10 senses an increase in temperature, the width or amplitude of the drive pulses is decreased and vice versa. It is clear that controller 25 may act to change the output 28 only upon the detection of temperature values beyond predetermined limits of a given temperature band.

Thus, what has been provided is a temperature control system for a thermal print head which responds to temperature changes at any point along a print line. Though, in the preferred embodiment, the temperature sensor bar has been employed in conjunction with a system employing a pair of continuous print bars, it is clear that is could be equally effectively used with a system employing a single continuous print bar or one employing a row of discrete thermal print elements. Furthermore, though the sensor bar has been described as a thermo-resistive type, it may alternatively be formed from thermo-voltaic material.

While the invention has been particularly shown and described with reference to a preferred embodiment, it will be understood by those skilled in the art that various other changes in form and detail may be made without departing from the spirit and scope of the invention.

We claim:

1. In a thermal print head having a row of thermal print elements, a temperature sensor comprising a sensor bar of temperature sensitive material positioned in parallel with and in heat transfer proximity to, the row of print elements, and a controller operatively connected to the sensor bar and responsive thereto for regulating the power input to the print elements.

2. A print head as claimed in claim 1 in which the length of the sensor bar is substantially equal to that of the row of print elements.

3. A thermal print head comprising a first continuous bar of resistive material, electrical connections to the first bar defining print elements therebetween, a second sensor bar of temperature sensitive material positioned in parallel with, and in heat transfer proximity to, the first bar for sensing the temperature of the first bar, and circuit means connected to the sensor bar for varying the print element drive pulse characteristics in accordance with the temperature sensed.

4. A thermal print head as claimed in claim 3 in which the sensor bar is formed from thermo-resistive material.

5. A thermal print head as claimed in claim 4 in which the first and second bars are mounted on an electrically insulating substrate carrying leads terminating in said electrical connections and said second bar is mounted over, but electrically insulated from, said leads.

6. A thermal print head as claimed in claim 3 in which the length of the second sensor bar is substantially equal to the length of said first continuous bar of resistive material.

7. A thermal print head as claimed in claim 6 including a further pair of leads carried by said substrate and connected respectively to the ends of the sensor bar.

8. A temperature control system for a thermal print head having a row of thermal print elements, comprising a temperature sensor bar positioned in parallel with, and in heat transfer proximity to, said row of thermal print heads and a control circuit coupled to the sensor bar and operative to control the energy of print drive pulses applied to the print elements in accordance with the temperature sensed by the sensor element.

9. A temperature control system as claimed in claim 8 in which the control circuit is effective to control the amplitude of said drive pulses.

10. A temperature control system as claimed in claim 9 in which the control circuit is effective to control the width of said drive pulses.

11. A temperature control system as claimed in claim 10, in which the lengths of the print element row and the sensor bar are substantially equal.

* * * * *